US006675678B2

(12) United States Patent
Liu

(10) Patent No.: US 6,675,678 B2
(45) Date of Patent: Jan. 13, 2004

(54) HEX WRENCH ASSEMBLY

(76) Inventor: Wei-Yuan Liu, No. 37, 15th Road, Tali Industrial Park, Taiping City, Taichung Hsien (TW)

( * ) Notice: Subject to any disclaimer, the term of this patent is extended or adjusted under 35 U.S.C. 154(b) by 0 days.

(21) Appl. No.: 10/163,112

(22) Filed: Jun. 6, 2002

(65) Prior Publication Data

US 2003/0226428 A1 Dec. 11, 2003

(51) Int. Cl.[7] ..... B25B 23/16
(52) U.S. Cl. ..... 81/177.2; 81/177.4; 81/439
(58) Field of Search ..... 81/437–439, 177.2, 81/177.4

(56) References Cited

U.S. PATENT DOCUMENTS 2,409,613 A * 10/1946 Brooks ..... 81/177.4

* cited by examiner

*Primary Examiner*—D. S. Meislin
(74) *Attorney, Agent, or Firm*—Charles E. Baxley

(57) ABSTRACT

A hex wrench assembly includes a tubular body having a reinforcement protrusion extending radially outward from a mediate portion of the body. A plurality of passages are defined in the body and a plurality of recesses are defined radially in an outer periphery of the body. Each recess shares a common axis of respective one of the passages. The head of a hex wrench is inserted in the passage and the handle of the wrench extends out from the recess.

2 Claims, 5 Drawing Sheets

HEX WRENCH ASSEMBLY

FIELD OF THE INVENTION

The present invention relates to a hex wrench assembly that has a reinforcement protrusion through which the passages for receiving hex wrenches are defined such that the thickness between two adjacent passages are strong enough.

BACKGROUND OF THE INVENTION

A conventional hex wrench assembly is shown in FIG. 1 and generally includes a tubular body 1 which has a plurality of open recesses 13 defined radially in one end of the body 10 and each open recess 13 communicates a passage 12 which shares a common axis with the open recess 13. A head of a hex wrench 11 is received in the passage 12 and the handle 112 extends out from the open recess 13. A user may hold the body 1 and rotates the body 1 about the axis of the handle 112 of the hex wrench 11. However, the thickness of the wall that separates the adjacent two open recesses 13 could be too thin if either one of the two adjacent open recesses 13 is for a large size hex wrench 11 to be received. The thin wall is not durable for a large stress applied onto it and could be broken during rotating the body 1 to tighten or loosen a bolt.

The present invention intends to provide a hex wrench assembly which includes an annular protrusion extending radially outward from a mediate portion of the tubular body and an open recess communicating with a passage is ended at the protrusion. A hex wrench is received in the passage and the open recess.

SUMMARY OF THE INVENTION

In accordance with one aspect of the present invention, there is a hex wrench assembly which includes a tubular body having a plurality of passages defined therein and a plurality of recesses are defined radially in an outer periphery of the body. Each recess shares a common axis of respective one of the passages. A reinforcement protrusion extends radially outward from an outer periphery of the body. A plurality of hex wrenches each have a head and a handle, wherein the handle or the head is inserted in one of the passages or the recesses.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
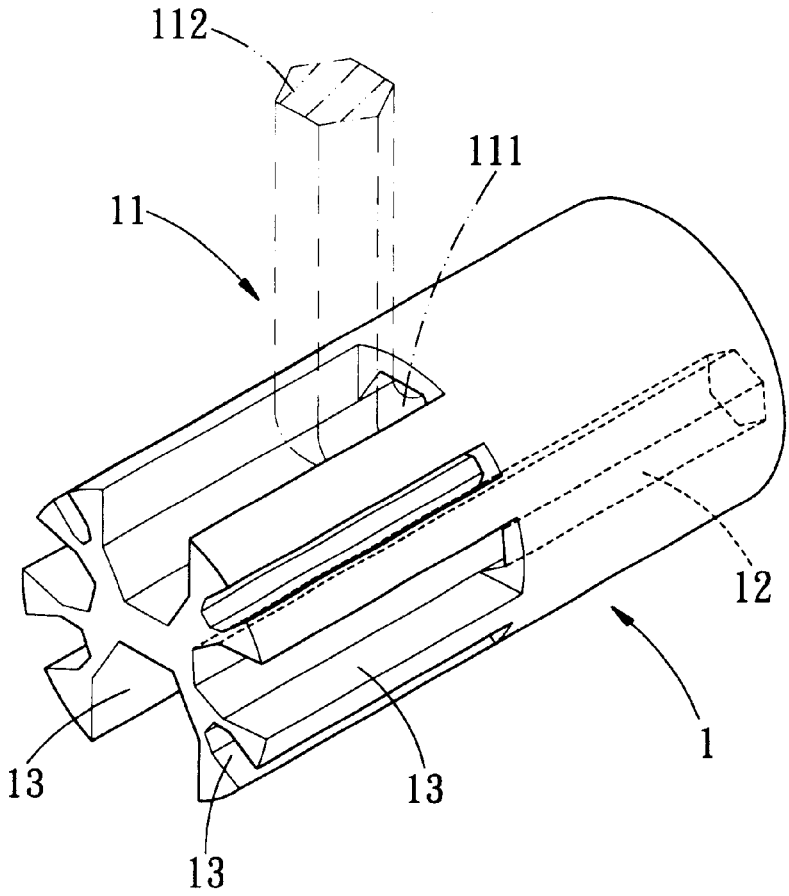
F I G. 1 PRIOR ART
FIG. 1 is a perspective view to show a conventional hex wrench assembly.
Figure 2:
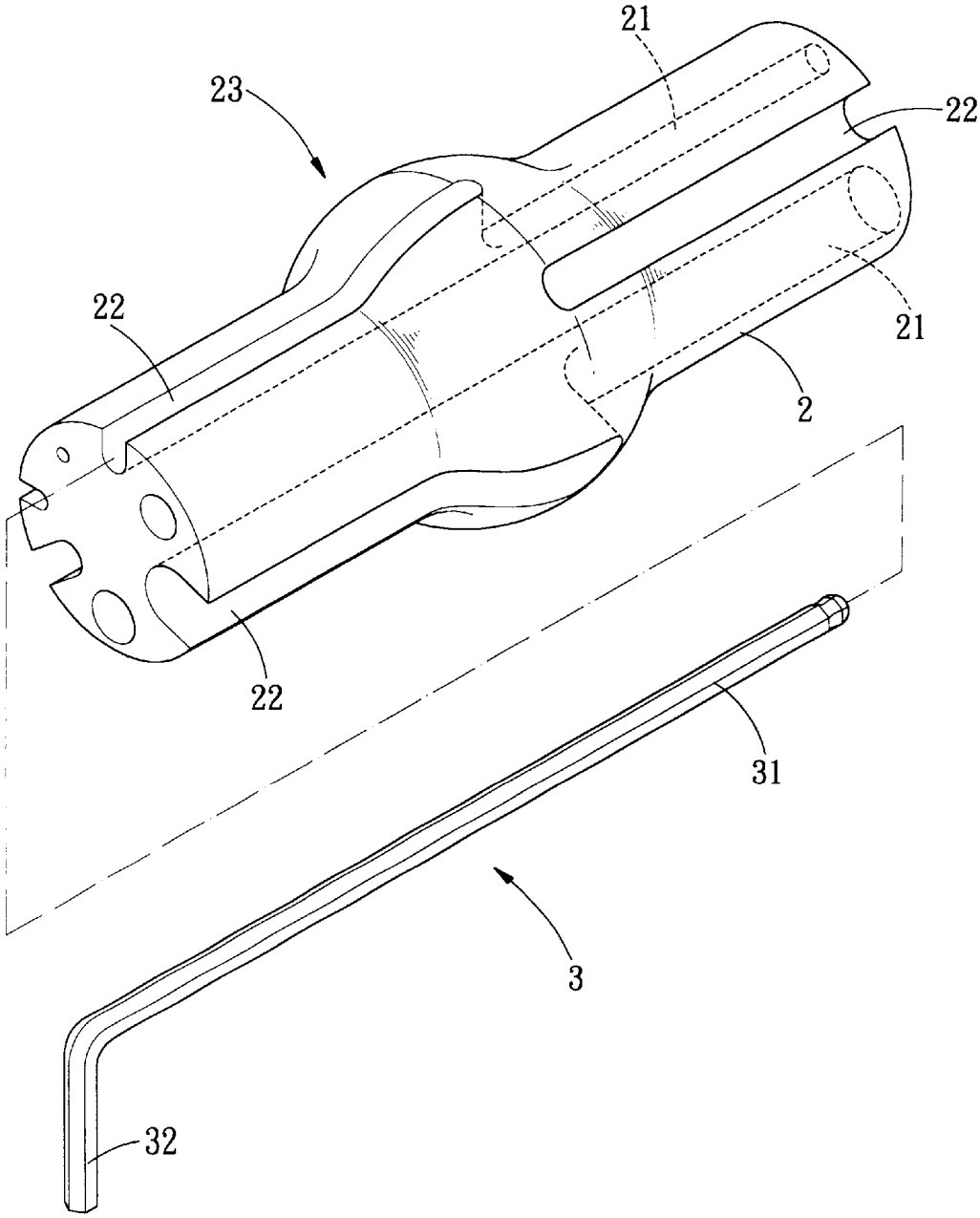
FIG. 2 is an exploded view to show the hex wrench assembly of the present invention.
Figure 3:
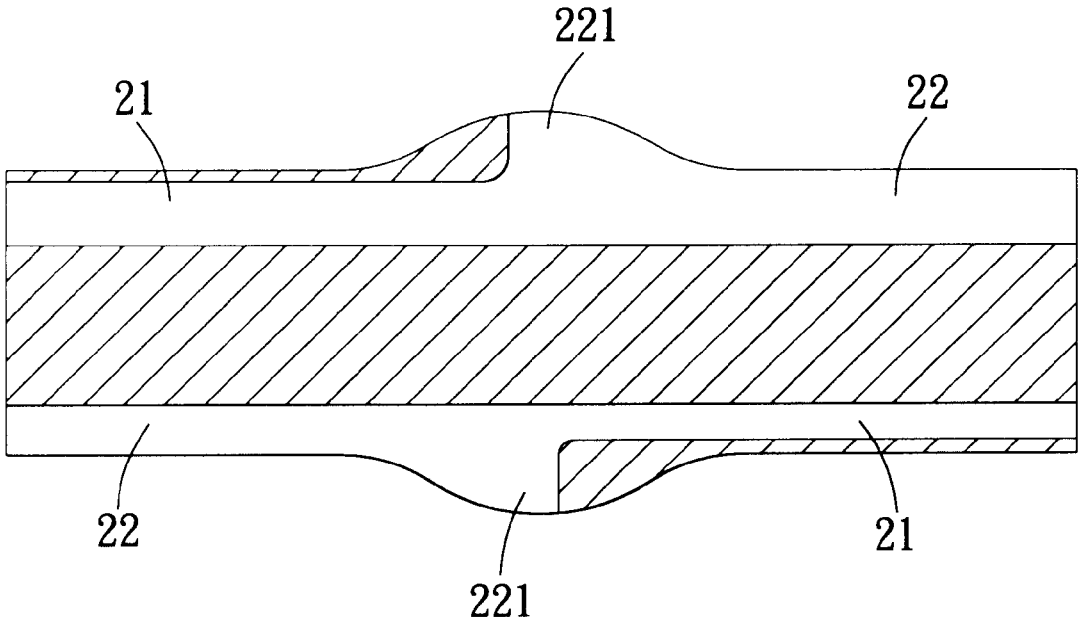
FIG. 3 is a cross sectional view to show the tubular body of the hex wrench assembly of the present invention.
Figure 4:
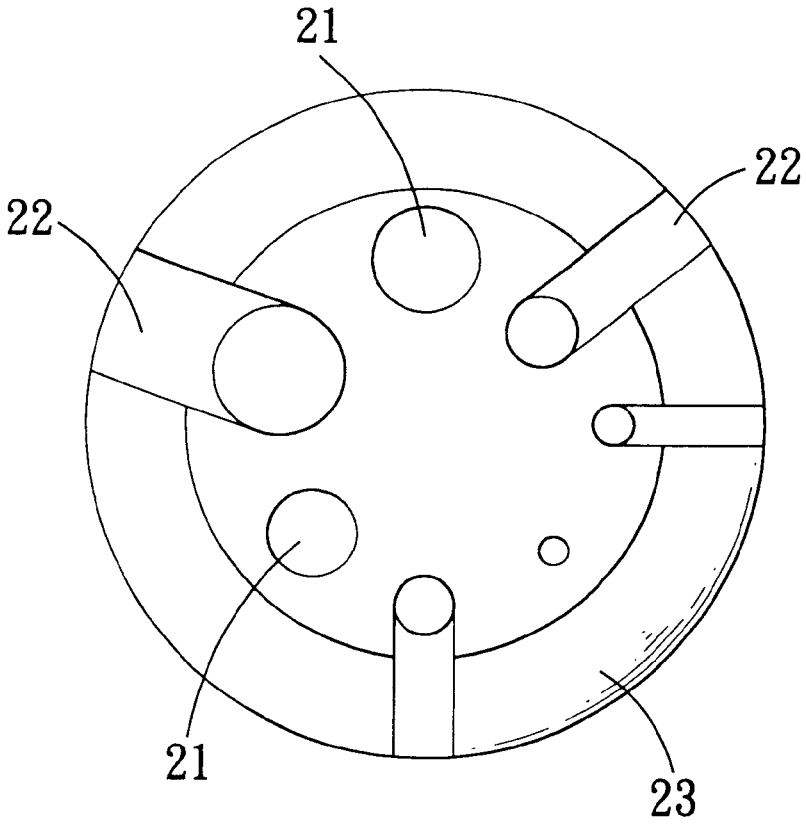
FIG. 4 is an end view to show the tubular body of the hex wrench assembly of the present invention.

Referring to FIGS. 2 to 4, the hex wrench assembly of the present invention comprises a tubular body 2 which has a plurality of passages 21 defined therein and a plurality of recesses 22 are defined radially in an outer periphery of the body 2. Each recess 22 shares a common axis of respective one of the passages 21. The passages and the recesses are defined in each of two ends of the tubular body. The passages 21 and the recesses 22 are located in alternatively when viewed from either one of the two ends of the tubular body 2.

A reinforcement protrusion 23 extends radially outward from a mediate portion of an outer periphery of the body 2. The recesses 22 are ended at the reinforcement protrusion 23. The length of the passage 21 is equal to the length of the recess 22.

A plurality of hex wrenches 3 each have a head 32 and a handle 31. The handle 31 is removably inserted in one of the passages 21 or recesses 22 so as to be secured in the tubular body 2.

Figure 5:
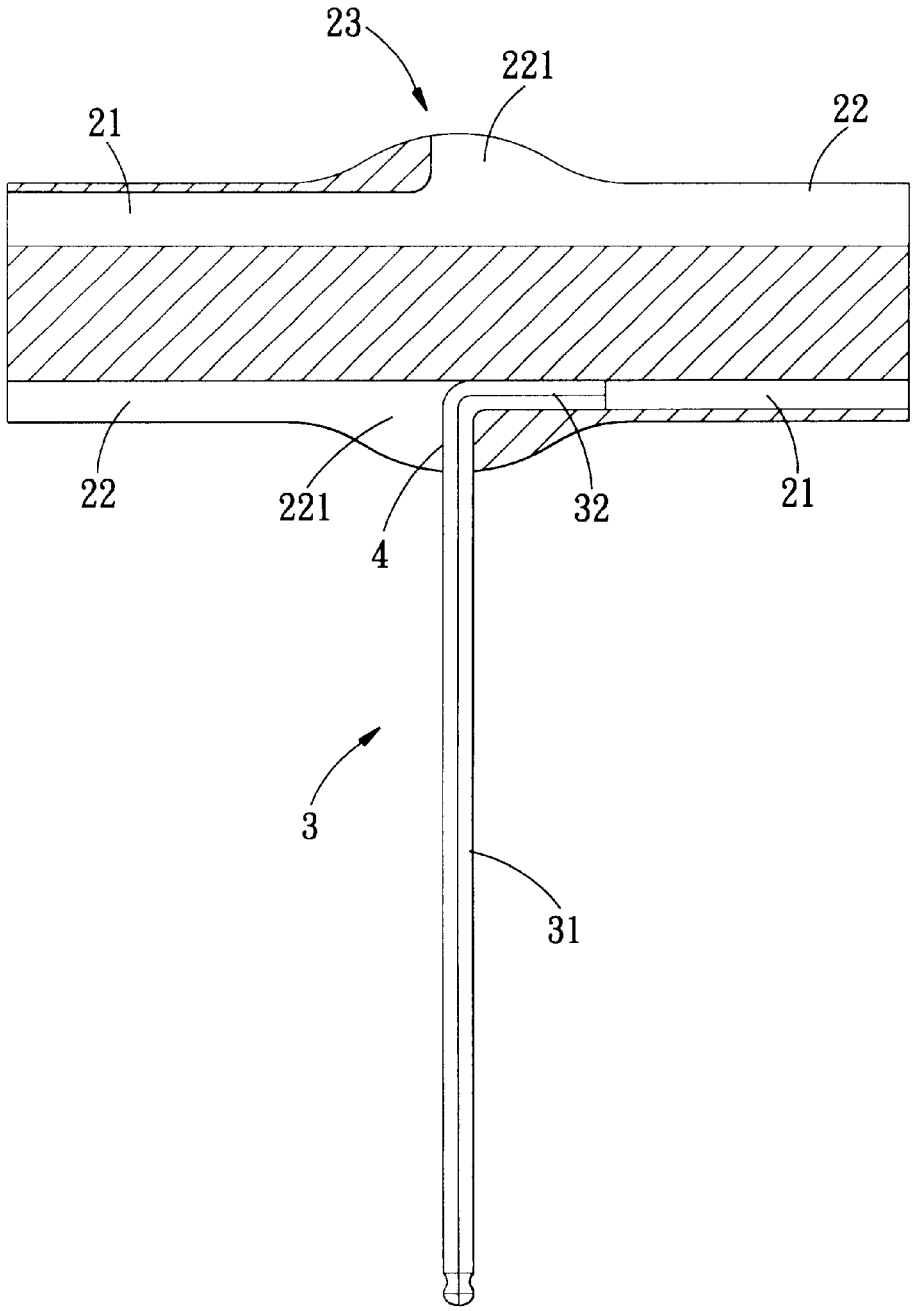
FIG. 5 shows the head of a hex wrench inserted in the passage and the handle extends from the recess.

As shown in FIG. 5, when using the hex wrenches 3, the head 32 can be inserted in the corresponding passage 21 from the corresponding recess 22 so as to let the handle 31 extend radially from the reinforcement protrusion 23. Because the reinforcement protrusion 23, the hex wrench 3 can be supported by a thicker wall 221 of the body 2 so as to bear a larger torque and/or stress.

While we have shown and described the embodiment in accordance with the present invention, it should be clear to those skilled in the art that further embodiments may be made without departing from the scope of the present invention.

What is claimed is:

1. A hex wrench assembly comprising:

a tubular body having a plurality of passages defined therein and a plurality of recesses defined radially in an outer periphery of the body, each recess sharing a common axis of respective one of the passages, the length of each of the passages is equal to the length of each of the recesses, the passages and the recesses defined in each of two ends of the tubular body;

a plurality of hex wrenches each having a head and a handle, the handle removably inserted in one of the passages or recesses, and a reinforcement protrusion extending radially outward from a mediate portion of an outer periphery of the body.

2. The hex wrench assembly as claimed in claim 1 wherein the passages and the recesses are located alternatively from each other when viewed from either one of the two ends of the tubular body.

* * * * *